US006032373A

United States Patent [19]

Peterson

[11] Patent Number: 6,032,373

[45] Date of Patent: Mar. 7, 2000

[54] METHODS AND APPARATUS FOR ADJUSTING CHAIN SAW TENSION

[76] Inventor: Robin A. Peterson, W5634 Evergreen #3 Rd., Menominee, Mich. 49858

[21] Appl. No.: 08/923,515

[22] Filed: Sep. 4, 1997

Related U.S. Application Data

[60] Provisional application No. 60/024,603, Sep. 5, 1996.

[51] Int. Cl.[7] ..... B27B 17/14

[52] U.S. Cl. ..... 30/386; 30/383

[58] Field of Search ..... 30/381, 382, 383, 30/384, 385, 386, 387; 63/814; 474/181, 110, 136

[56] References Cited

U.S. PATENT DOCUMENTS

| | | | |
|---|---|---|---|
| 1,865,087 | 6/1932 | Daniel | 474/136 |
| 2,765,821 | 10/1956 | Strunk | 30/386 |
| 3,098,397 | 7/1963 | Schaefer | 474/110 |
| 3,194,284 | 7/1965 | Walker | 474/136 |
| 3,279,508 | 10/1966 | Ehlen et al. | 30/385 |
| 3,636,995 | 1/1972 | Newman | 143/32 J |
| 4,486,953 | 12/1984 | Halverson | 30/385 |
| 4,567,658 | 2/1986 | Wissmann et al. | 30/386 |
| 4,615,117 | 10/1986 | Flath | 30/122 |
| 4,726,801 | 2/1988 | Stark | 474/101 |
| 4,819,332 | 4/1989 | Sugihara et al. | 30/123.4 |
| 4,884,340 | 12/1989 | Newman | 30/122 |
| 4,945,637 | 8/1990 | Anderson | 30/122 |
| 5,345,686 | 9/1994 | Zimmermann | 30/386 |
| 5,528,835 | 6/1996 | Ra | 30/386 |
| 5,709,254 | 1/1998 | Argue | 144/34.1 |

*Primary Examiner*—M. Rachuba
*Assistant Examiner*—Stephen Choi
*Attorney, Agent, or Firm*—Mau & Krull, P.A.

[57] ABSTRACT

A chain saw includes a chain formed into a closed loop about a drive sprocket and a support bar. A first piston is operable to move the support bar radially away from the drive sprocket, and a second piston is operable to limit such movement.

18 Claims, 7 Drawing Sheets

METHODS AND APPARATUS FOR ADJUSTING CHAIN SAW TENSION

CROSS-REFERENCE TO RELATED APPLICATION

This application claims subject matter disclosed in Provisional Application No. 60/024,603, filed on Sep. 5, 1996.

FIELD OF THE INVENTION

The present invention relates to methods and apparatus for adjusting tension in a saw chain or other continuous loop.

BACKGROUND OF THE INVENTION

Chain saws have existed for quite some time and have proven very useful in the clearing of land and harvesting of wood. One such chain saw assembly is designated as 100 and labeled as "Prior Art" in FIG. 3. The prior art assembly 100 generally includes a saw portion, a saw chain rotating portion, a saw chain translating portion, and a saw chain tension adjusting portion. The saw portion may be said to include a 0.75 pitch chain saw chain 110 (sold as part number 11BC by Oregon Cutting Systems of Portland, Oreg.) disposed about both a drive sprocket 120 and a saw bar 130, the latter extending radially away from the former.

The saw chain rotating portion may be said to include the saw portion and a means for rotating the saw chain 110 together with the drive sprocket 120 and about the saw bar 130. This rotating means is provided by a motor (not shown) having a shaft to which the drive sprocket 120 is keyed.

The saw chain translating portion may be said to include the saw portion and a means for translating the saw portion through a range of motion. This translating means is provided by a hydraulic cylinder 140 having a first end 141 connected to the frame of the saw (which coincides with the motor housing), and a second end 142 connected to a pivot arm 150. The pivot arm 150 is rotatably mounted on the motor shaft, between the motor housing and a ring plate 160. The saw bar 130 is also connected to the pivot arm 150, at a point approximately ninety degrees displaced from the second end 142 of the cylinder 140 (relative to the axis of the motor shaft). The arrangement of the pivot arm 150, the saw bar 130, and the cylinder 140 is such that actuation of the cylinder 140 causes rotation of the saw bar 130 and saw chain 110 about the motor shaft.

The saw chain tension adjusting portion may be said to include a means for moving the saw bar 130 radially relative to the drive sprocket 120. Movement of the saw bar 130 away from the drive sprocket 120 increases tension in the saw chain 110, and movement of the saw bar 130 toward the drive sprocket 120 decreases tension in the saw chain 110. This moving means is provided by slidably mounting the saw bar 130 to the pivot arm 150. In particular, a plate 170 is rigidly secured to the saw bar 130 and slidably secured to the pivot arm 150. A screw 175 is threaded through a flange 176 on the plate 170 and into contact with a bearing surface 156 on the pivot arm 150. Rotation of the screw 175 causes the plate 120 and the saw bar 130 to move radially relative to the motor shaft and hence, the drive sprocket 120.

The foregoing chain saw assembly 100 leaves room for improvement. For example, the drive sprocket 120 is secured to the shaft in such a manner that undesirable side-loads and/or excessive keyway wear may result. Also, sawdust and other debris may reach the motor relatively unobstructed and thereby interfere with its operation and/or durability. Moreover, the nature of the tension adjusting portion of the chain saw assembly 100 is both subjective and unyielding and thus, can both hinder operation and/or contribute to wear and tear of the saw and its components. In other words, there exists a need for an improved chain saw assembly, preferably one that can be "retrofitted" onto existing equipment in a manner that is relatively simple and cost effective.

SUMMARY OF THE INVENTION

The present invention provides an improved chain saw. In one regard, an adjustment member is rigidly mounted on a saw bar and slidably mounted to a pivot arm in a manner that allows self-limiting or self-regulating adjustment of saw chain tension. This improved adjustment member and pivot arm combination may be installed on existing equipment with relatively little cost or inconvenience. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
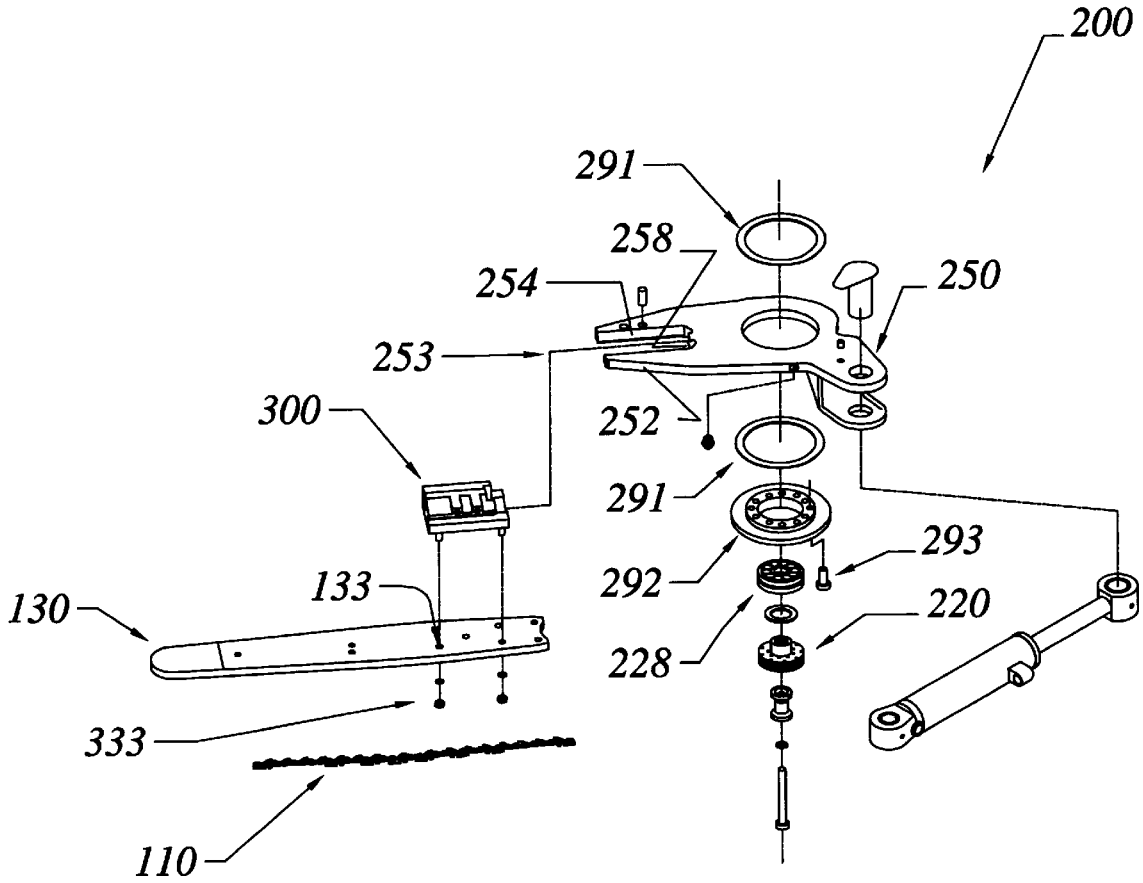
FIG. 1 is an exploded perspective view of a chain saw assembly constructed according to the principles of the present invention.
Figure 2:
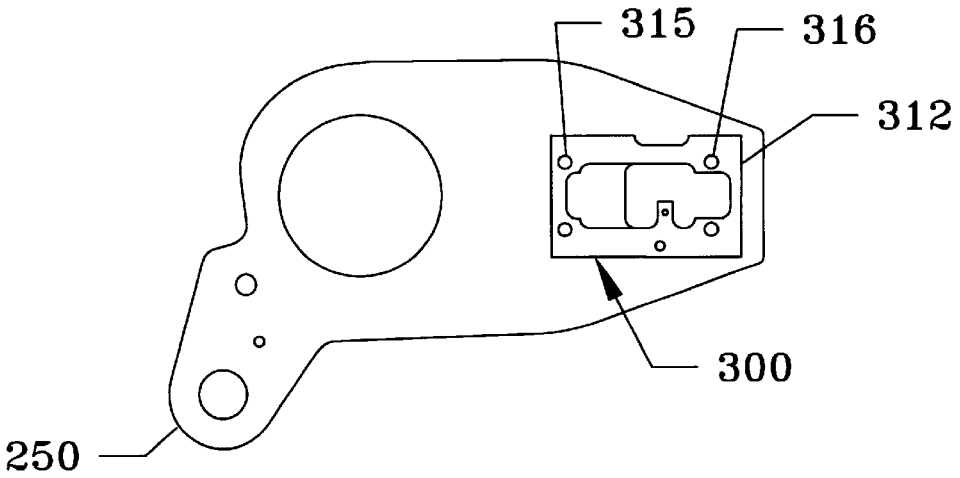
FIG. 2 is a partially sectioned side view of the chain saw assembly of FIG. 1.
Figure 3:
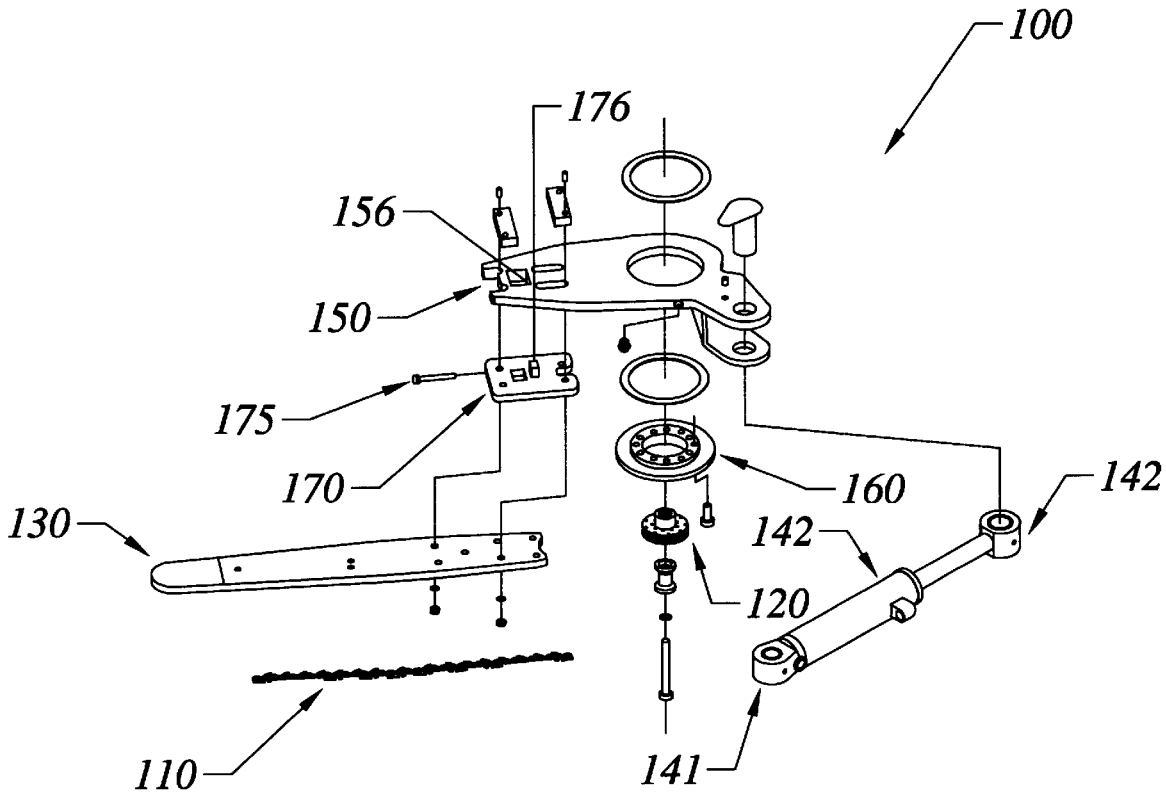
FIG. 3 is an exploded perspective view of a chain saw assembly constructed in a manner already known in the art.
Figure 5:
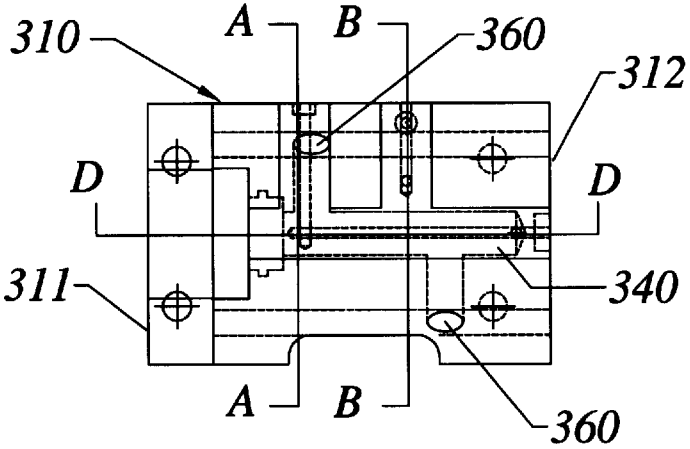
FIG. 5 is a top view of the moving member of FIG. 4, with hidden lines shown to provide context for section lines along which additional views are taken.
Figure 6:
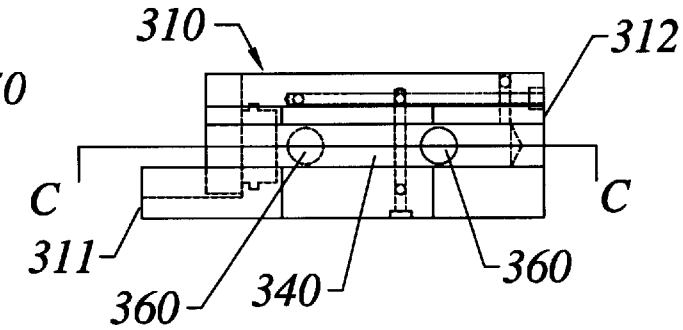
FIG. 6 is a side view of the moving member of FIG. 4, with hidden lines shown to provide context for section lines along which additional views are taken.

A preferred embodiment chain saw assembly constructed according to the principles of the present invention is designated as 200 in FIGS. 1–2. The preferred embodiment assembly 200 is similar in certain respects to the prior art assembly 100 shown in FIG. 3. The differences or improvements on the preferred embodiment 200 are present in the saw chain rotating portion and the saw chain tensioning portion of the apparatus. In particular, a new drive sprocket 220 and a new bearing 228 are substituted for the drive sprocket 120 on the prior art device 100; and a new pivot arm 250 and a new adjustment member 300 are substituted for the pivot arm 150 and the adjusting plate 170 on the prior art device 100.

The new adjustment member 300 is shown in greater detail in FIGS. 5–12. The adjustment member 300 includes a housing or base 310; a longitudinal or tensioning piston 344 which moves in a first, longitudinal direction relative to the base 310; and two transverse or locking pistons 366 which move in a second, perpendicular or transverse direction relative to the base 310.

Figure 4:
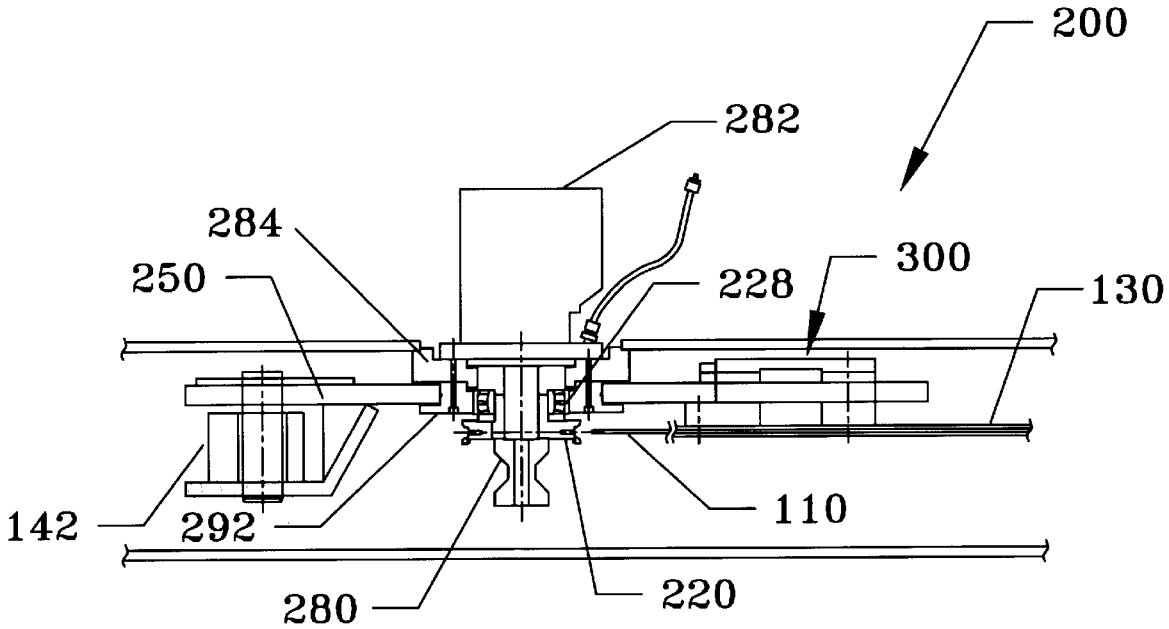
FIG. 4 is a bottom view of first and second members, one of which moves relative to the other to adjust chain tension in the chain saw assembly of FIGS. 1–2.

The base 310 has a near or proximate end 311 and a far or distal end 312 (as viewed relative to the pivot arm 250 in FIG. 4, for example). Threaded holes 315 extend through the base 310 proximate the near end 311, and threaded holes 316 extend into the bottom of the base 310 proximate the far end 312. Bolts 333 extend through aligned holes 133 in the saw bar 130 and thread into engagement with the holes 315 and the holes 316 to rigidly secure the base 310 to the saw bar 130. Lubricating oil for the saw chain 110 enters the base 310 at port 321, travels through a bar lubrication passage 324, and exits the base 310 at port 322.

Figure 7:
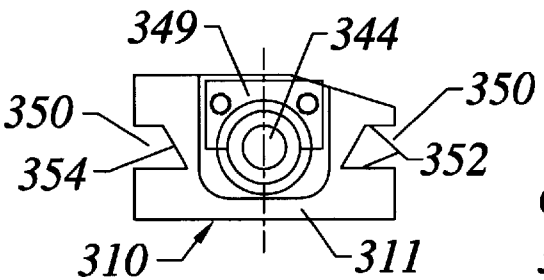
FIG. 7 is an end view of the moving member of FIG. 4.
Figure 8:
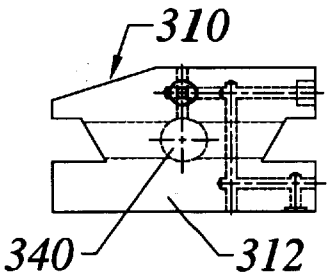
FIG. 8 is an opposite end view of the moving member of FIG. 4 with hidden lines shown to help illustrate passages through the second member.
Figure 10:
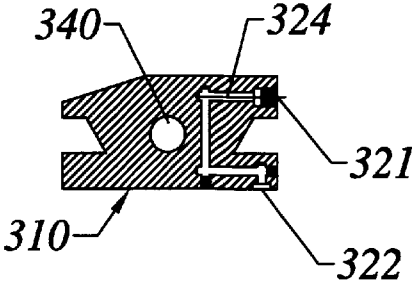
FIG. 10 is a sectioned end view of the moving member of FIG. 4, taken along the line B—B of FIG. 5.
Figure 9:
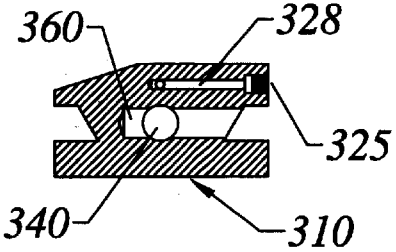
FIG. 9 is a sectioned end view of the moving member of FIG. 4, taken along the line A—A of FIG. 5.
Figure 11:
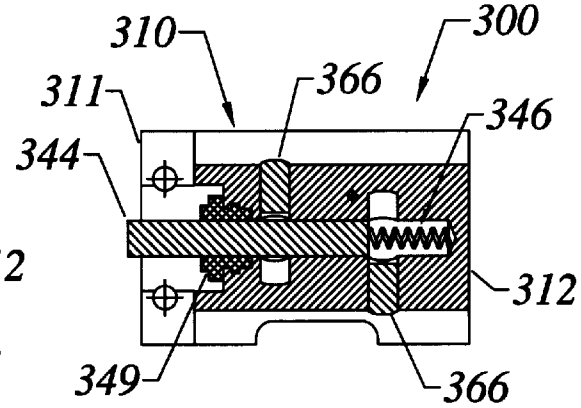
FIG. 11 is a sectioned top view of the moving member of FIG. 4, taken along the line C—C of FIG. 6.
Figure 12:
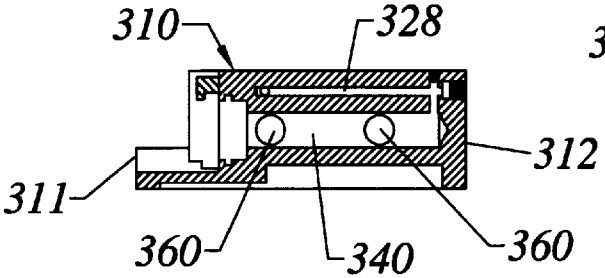
FIG. 12 is a sectioned side view of the moving member of FIG. 4, taken along the line D—D of FIG. 5.

As shown in FIGS. 11–12, a longitudinal bore 340 extends into the near end 311 of the base 310 to receive the longitudinal or tensioning piston 344. As shown in FIG. 7, a retaining bracket and/or gasket 349 effectively seals the bore 340 while allowing the longitudinal piston 344 to protrude outside the base 310 and move relative thereto. The longitudinal piston 344 is acted upon by hydraulic fluid which enters the base 310 at port 325 and travels through a passage 328 to both the longitudinal bore 340 and transverse bores 360. Also, a spring 346 is compressed between the longitudinal piston 344 and the portion of the base 310 defining the end wall of the bore 340.

As shown in FIGS. 7–10, channels 350 are formed in opposite sides of the base 310. Each channel 350 has opposing sidewalls 352 which extend parallel to one another and parallel to their counterparts on the opposite channel 350. Each channel 350 has a base wall 354 which is inclined or skewed relative to the sidewalls 352. A lateral bore 360 extends through each base wall 354, parallel to the sidewalls 352, and perpendicular to the longitudinal bore 340. The lateral bores 360 extend through longitudinally displaced portions of the longitudinal bore 340.

Figure 13:
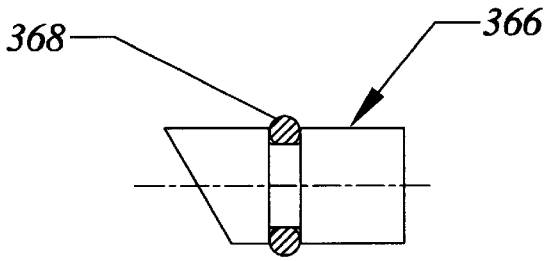
FIG. 13 is a side view of a piston disposed within the moving member of FIG. 4.

Each lateral bore 360 receives one of the transverse or clamping piston 366, one of which is shown in FIG. 13. An 0-ring 368 effectively seals each lateral bore 360 while allowing the respective lateral piston 366 to protrude outside the base 310 and move relative thereto. The lateral pistons 366 are similarly acted upon by hydraulic fluid from the passage 328.

Figure 14:
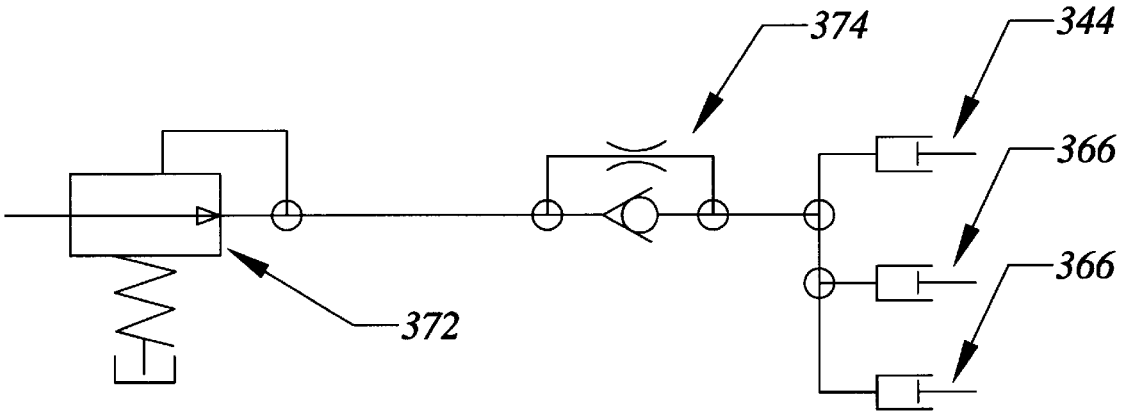
FIG. 14 is a schematic diagram of the hydraulic system which causes relative movement of the first and second members of FIG. 4.

The hydraulic fluid is supplied to both the lateral pistons 366 and the longitudinal piston 344 in accordance with the schematic diagram of FIG. 14. In response to input from a user or other controller, the pressurized fluid flows through a reducing valve 372 and a check valve 374 and then through the port 325 and into the bores 340 and 360. The pressure of the fluid biases the pistons 366 and 344 outward from the base 310. The design of the system is such that the longitudinal piston 344 pushes the saw bar 130 away from the pivot arm 250 until the saw chain 110 is taut, and then fluid pressure build-up within the bores 340 and 360 increases the locking force imparted by the transverse pistons 366.

The check valve 374 functions as a bleed orifice which allows the fluid to drain from the bores 340 and 360 at a rate which is disproportionate to the pressure differential on opposite sides thereof. In other words, the check valve 374 prevents the fluid from leaving the bores 340 and 360 so quickly that saw chain tension is not maintained during saw operation, but allows the fluid to leave quickly enough to accommodate saw chain shrinkage when the saw 200 is not in use. As the dormant saw chain 110 cools, and the fluid pressure decreases, the pistons 344 and 366 exert less force, and the shrinking saw chain 110 urges the saw bar 130 back toward the pivot arm 250. The compressive force of the spring 346 acts to limit retraction of the saw bar 130 and to maintain sufficient tension in the saw chain 110 to prevent it from coming off the saw bar 130.

As shown in FIG. 1, the new pivot arm 250 includes opposing rails 252 which border opposite sides of a slot 253. The width of the slot 253, as measured between opposing surfaces 254 on the rails 252, is approximately equal to the width of the base 310, as measured between the channel base walls 354. Also, each rail 252 has a one-half dovetail cross-section similar to that of each channel 350. In particular, the opposing surfaces 254 on the rails 252 extend substantially parallel to the base walls 354 of the channels 350 when the latter slides between the former. In other words, the adjustment member 300 and the pivot arm 250 may be said to cooperate or interact in sliding dovetail fashion. The depth of the slot 253 on the pivot arm 250 is bounded by a base wall 258 which extends perpendicular to the opposing surfaces 254 and perpendicular to the mean plane defined by the pivot arm 250.

As with the prior art device 100, the pivot arm 250 on the preferred embodiment 200 is rotatably mounted on the motor shaft (which is designated as 280 in FIG. 2). In particular, thrust washers 291 are disposed on opposite sides of the pivot arm 250 and secured between the motor mounting 284 and a ring plate 292 by means of screws 293. A separate portion of the pivot arm 250, which remains the same as that of the prior art device 100, is secured to one end of a hydraulic cylinder 140 in such a manner that contraction of the cylinder 140 causes the saw portion to pivot away from the cylinder 140, and extension of the cylinder 140 causes the saw portion to pivot toward the cylinder 140. Both the motor 282 and an opposite end of the hydraulic cylinder 140 are rigidly secured to discrete portions of the main frame of the saw.

Figure 17:
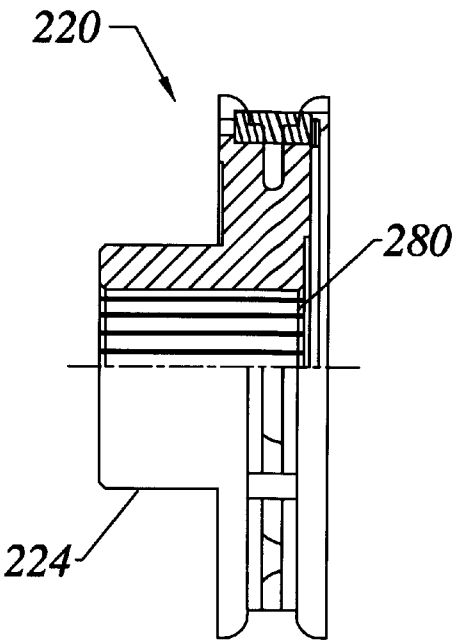
FIG. 17 is a partially sectioned, opposite side view of the drive sprocket of FIG. 15.
Figure 15:
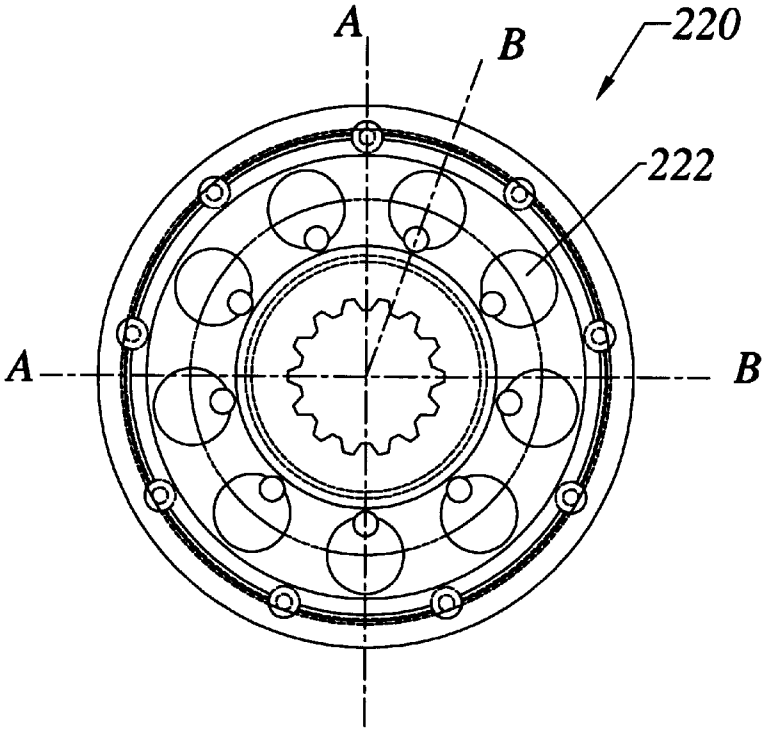
FIG. 15 is a top view of a drive sprocket from the chain saw assembly of FIGS. 1–2.
Figure 16:
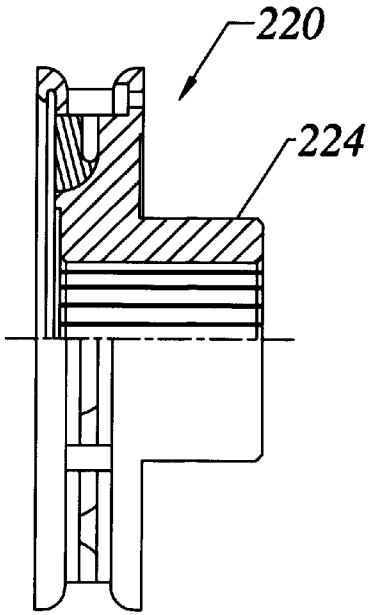
FIG. 16 is a partially sectioned side view of the drive sprocket of FIG. 15.

As shown in FIGS. 15–17, the new drive sprocket 220 is mounted to the motor shaft 280 be means of an involute spline. The drive sprocket 220 is configured to engage the saw chain 110 and to rotate together therewith in response to rotation of the shaft 280. Holes 222 through the sprocket 220 allow sawdust and other debris to be discharged away from the chain 110, the bearing 228, and the motor 282. The drive sprocket 220 also provides a hub 224 about which the external support bearing 228 is secured. The bearing 228, in turn, nests within a recess (not shown) in the ring plate 292. In this manner, the ring plate 292 directly supports the drive sprocket 220 against potentially harmful side-loading, and the bearing 228 covers the holes 222 through the sprocket 220, thereby encouraging sawdust and other debris to be discharged away from the motor and the bearing 228.

The relative spacing of the drive sprocket 220, the bearing 228, the ring plate 292, and the pivot arm 250 is such that the saw bar 130 extends radially away from the drive sprocket 220 when the saw is assembled (as shown in FIG. 2). As a result, the saw bar 130 and the drive sprocket 220 cooperate to define a a perimeter about which the saw chain 110 is disposed, and, as noted above, the tension in the saw chain 110 may be adjusted by moving the saw bar 130 radially relative to the drive sprocket 220.

When the adjustment member 300 is mounted on the pivot arm 250, the compression in the spring 346 keeps the saw chain 110 from coming off the saw bar 130, and the tension in the saw chain 110 keeps the adjustment member 300 from sliding out of the slot 253. The introduction of hydraulic fluid into the adjustment member 300 urges the longitudinal piston 344 and both lateral pistons 366 outward toward respective bearing surfaces on the pivot arm 250. The longitudinal force exerted against the base wall 258 of the slot 253 is in a direction parallel to the direction in which the adjustment member 300 is free to travel, whereas the lateral forces exerted against the side walls 254 of the slots 252 are exerted in a direction perpendicular to the direction in which the adjustment member 300 is free to travel. The overall configuration is such that the longitudinal force dominates or overcomes the lateral forces until sufficient tension in the saw chain 110 is established, at which point a satisfactory equilibrium is reached. In this regard, the saw chain adjusting means of the present invention may be said to be self-limiting.

The present invention has been described with reference to a preferred embodiment and a particular application. Recognizing that the foregoing description will allow those skilled in the art to recognize additional embodiments and applications, the scope of the present invention should be construed to include all such variations.

What is claimed is:

1. A chain saw, comprising:

a bar;

a drive member;

a continuous loop of chain fitted about the bar and the drive member; and an adjusting means for adjusting the bar relative to the drive member, wherein the means automatically prevents chain tension from exceeding a predetermined limit as chain tension increases in response to user input, and the means automatically prevents chain tension from exceeding the predetermined limit as chain tension increases in response to cooling of the chain, wherein the adjusting means includes a first piston which is movable in a first direction to adjust the bar relative to the drive member, and a second piston which transmits force in a second, perpendicular direction to resist movement of the first piston.

2. A chain saw, comprising:

a bar;

a drive member;

a continuous loop of chain fitted about the bar and the drive member; and an adjusting means for adjusting the bar relative to the drive member, wherein the means automatically prevents chain tension from exceeding a predetermined limit as chain tension increases in response to user input, and the means automatically prevents chain tension from exceeding the predetermined limit as chain tension increases in response to cooling of the chain, wherein the drive member rotates about an axis, and the adjusting means includes: (a) a support member which is secured against translation relative to the axis; and (b) an actuator which is rigidly secured to the bar and radially movable relative to the support member and the axis.

3. The chain saw of claim 2, wherein the support member defines a radially extending slot, and the actuator is movably mounted within the slot.

4. The chain saw of claim 3, wherein the slot is defined between opposing rails having a one-half dovetail configuration, and complementary grooves are formed in opposite sides of the actuator to accommodate the rails.

5. The chain saw of claim 3, wherein the actuator includes at least one radially extending piston which is movable into contact with a first bearing surface on the support member.

6. The chain saw of claim 5, wherein a coil spring is interconnected between the piston and an end of the actuator opposite the first bearing surface.

7. The chain saw of claim 5, wherein the actuator includes at least one transversely extending piston which is movable into contact with a second bearing surface on the support member.

8. The chain saw of claim 7, wherein the at least one transversely extending piston and at least one radially extending piston are in fluid communication with a common reservoir of hydraulic fluid.

9. The chain saw of claim 8, wherein the at least one transversely extending piston and at least one radially extending piston are in fluid communication with a common bleed orifice.

10. A chain saw, comprising:

a support structure;

a drive member rotatably mounted on the support structure and rotatable about an axis;

a guide member movably mounted on the support structure and movable in a radial direction relative to the drive member, wherein the guide member and the drive member define an effective perimeter;

a continuous loop of chain fitted about the guide member and the drive member; and an actuator having a base fastened to the guide member, at least one radially extending piston movable relative to the base and into contact with a first portion of the support structure, and at least one transversely extending piston movable relative to the base and into contact with a second portion of the support structure, wherein force exerted against the first portion of the support structure by the at least one radially extending piston urges the guide member radially away from the drive member, and force exerted against the second portion of the frame by the at least one transversely extending piston resists movement of the guide member relative to the drive member.

11. The chain saw of claim 10, wherein the support structure defines a radially extending slot, and the actuator is movably mounted within the slot.

12. The chain saw of claim 11, wherein the slot is defined between opposing rails having a one-half dovetail configuration, and complementary grooves are formed in opposite sides of the actuator to accommodate the rails.

13. The chain saw of claim 11, wherein the first portion of the support structure is a transversely extending base wall which bounds the slot.

14. The chain saw of claim 13, wherein the second portion of the support structure includes a pair of radially extending side walls which bound the slot.

15. The chain saw of claim 10, wherein the at least one transversely extending piston and at least one radially extending piston are in fluid communication with a common reservoir of hydraulic fluid.

16. The chain saw of claim 15, wherein the at least one transversely extending piston and at least one radially extending piston are in fluid communication with a common bleed orifice.

17. The chain saw of claim 10, wherein a coil spring is interconnected between the at least one radially extending piston and an end of the actuator opposite the first portion of the support structure.

18. A method of adjusting a first support relative to a second support to establish a desired amount of tension in a closed loop disposed about the first support and the second support, comprising the steps of:

connecting the first support to a first member;

configuring the first member to have a first bearing surface and a second bearing surface which extend generally perpendicular to one another;

connecting the second support to a second member;

movably mounting the second member on the first member so as to be movable in a direction generally parallel to the first bearing surface;

movably mounting a first piston on the second member so as to be movable into contact with the first bearing surface;

movably mounting a second piston on the second member so as to be movable into contact with the second bearing surface; and selectively placing pressurized fluid in fluid communication with the first piston and the second piston to press the pistons against respective bearing surfaces in such a manner that the second member is moved away from the first member and then held in place once the desired amount of tension in the closed loop is established.

* * * * *